US005450274A

United States Patent [19]

Wiesinger et al.

[11] Patent Number: 5,450,274

[45] Date of Patent: Sep. 12, 1995

[54] SPARK GAP ARRANGEMENT

[75] Inventors: Johannes Wiesinger, Puccheim; Wolfgang Zischank, Neubiberg; Peter Hasse, Neumarkt/OPf.; Walter Aumeier, Neumarkt/OPf.; Peter Zahlmann, Neumarkt/OPf.; Raimund Konig, Sengenthal; Georg Wittmann, Lauterhofen, all of Germany

[73] Assignee: DEHN & Söhne GmbH & Co. KG, Germany

[21] Appl. No.: 157,286

[22] Filed: Nov. 26, 1993

[30] Foreign Application Priority Data

Nov. 28, 1992 [DE] Germany ..... 42 40 138.0

[51] Int. Cl.[6] ..... H01T 5/00

[52] U.S. Cl. ..... 361/130; 361/118

[58] Field of Search ..... 361/117, 118, 120, 129, 361/130

[56] References Cited

U.S. PATENT DOCUMENTS 4,345,295 8/1982 Hasse et al. ..... 361/130
4,366,523 12/1982 Hasse et al. ..... 361/130

FOREIGN PATENT DOCUMENTS 2934236 3/1981 Germany .
2934238 3/1981 Germany .
3914624 11/1990 Germany .
449106 12/1967 Switzerland .

*Primary Examiner*—A. D. Pellinen
*Assistant Examiner*—Sally C. Medley
*Attorney, Agent, or Firm*—Bacon & Thomas

[57] ABSTRACT

A spark gap arrangement capable of handling lightning includes a first spark gap with a relatively high-resistance insulating layer having a relatively short spark-over path, and at least one second spark gap which, compared to the first spark gap, has a relatively low-resistance insulating layer with a relatively long spark-over path, the second spark gap being electrically connected in series to the first spark gap.

34 Claims, 5 Drawing Sheets

SPARK GAP ARRANGEMENT

BACKGROUND OF THE INVENTION

1. Field of the Invention

This invention relates to a spark gap arrangement capable of carrying lightning current.

2. Description of Related Art

German published patent application No. DE-OS 39 14 624 discloses a spark gap arrangement which includes two series-connected spark gaps and is capable of carrying lightning current. Each spark gap consists of two electrodes and an insulating layer arranged between the two electrodes, thereby providing a spark-over path is provided between the two electrodes, and the thickness of at least one of the insulating layers in the two spark gaps is different from the thickness of the other insulating layer(s). In this arrangement, the insulating layers with different thicknesses consist of the same material and accordingly have the same specific resistance.

German patents DE-PS 29 34 238 and 29 34 236 also disclose spark gap arrangements which include a plurality of series-connected spark gaps and are capable of carrying lightning current, and in which each spark gap consists of two electrodes and an insulating layer with a spark-over path arranged between the two electrodes. Such arrangements are particularly widely used in low-voltage installations, especially on the input side when the installation is connected to the main power line or grid.

In the arrangement described in DE-PS 29 34 238, for example, the insulating layers are made of a material which, when heated, and in particular when heated by an arc, gives off a gas which pushes or blows the arc to the outside. The insulating material is described as being preferably in the form of a thermoplastic plastic that gives off hydrogen gas ($H^2$), e.g. polymethylene oxide (PMO). However, this publication does not touch upon the subject matter of the present invention, either by recognizing the problem solved or by proposing a solution, as will become apparent from the description of the invention which follows this description of related art. The arrangement described in DE-PS 29 34 236 similarly attempts to provide improved dissipation of currents, but has the disadvantage of a relative high response voltage, which renders its practical use in certain field installations difficult.

On the other hand, DE-PS 39 14 624 describes an arrangement which attempts to achieve a low response voltage with a high current carrying capacity and direct dissipation of a primary lightning-induced current after a strike, but in practice is only able to achieve relatively small capacity ratios of 1:6. As a result, practical use of this arrangement is limited whenever higher requirements have to be met.

Swiss patent No. CH-PS 449 106 discloses an over-voltage arrester which has a series connection of spark gap stacks and voltage-dependent resistors, in which the spark gap stacks and the voltage-dependent resistors alternate in the series. In this arrangement, every spark gap stack is connected in parallel to a control resistor. The space between the active part of the arrangement and an insulating housing surrounding it is filled with a foam, the pores of which contain an electro-negative gas. The Swiss publication does not give any indication as to the type of control resistors which ensure that a control effect can be obtained, nor does it discuss the control effect itself. Furthermore, the over-voltage arrester according to CH-PS 449 106 is expensive to produce as a result of the indicated series connection and the parallel control resistors, and as a result of the provision of a housing, which also has the disadvantage of requiring a considerable amount of space, which in practice is often not available.

The primary objective of the above-mentioned devices is to provide a spark gap arrangement capable of carrying lightning current in which, after a current pulse reaches a protection level, the energy contained in the current pulse is safely and controllably discharged in a manner which protects connected installations and equipment.

In order to accomplish this objective, the excess current which occurs when the spark gap responds is dissipated in the next zero passage of the current, or must be carried without destruction until interruption by a prefuse. This results in contradictory requirements. On the one hand, the response voltage of the spark gap must be as low as possible, which as a rule is obtained by minimizing the distance between the electrodes of the spark gap. On the other hand, for secure dissipation of the short circuit current, it is desirable to provide a voltage drop across the spark gap which is as high as possible, and which can best be realized by a great distance between the electrodes. This in turn, however, increases the response voltage (see above).

Other known measures for dissipating the short circuit current are also disadvantageous. For example, an increase in the field strength of the arc by cooling requires a correspondingly large volume of the spark gap. Also, the series connection of several spark gaps, which is realized in the aforementioned state of the art, causes an undesirable increase in the response voltage of the overall arrangement.

SUMMARY OF THE INVENTION

In order to overcome the above-described disadvantages of the prior art, it is an objective of the invention to provide a spark gap arrangement capable of carrying a lightning current in such a way that a low response voltage is obtained together with a good dissipating capacity of the excess current, while retaining the required lightning current carrying capacity.

This objective is preferably achieved by providing a first spark gap with a relatively high-resistance insulating layer which has a relatively short spark-over path and by providing at least one second spark gap which, compared to the first spark gap, has a relatively low-resistance insulating layer with a relatively long spark-over path, the second spark gap being electrically connected in series to the first spark gap.

With this arrangement, the disadvantages explained above in connection with the prior art are avoided. If an over-voltage occurs, then the greater part of the voltage drop will occur on the high-resistance first spark gap, so that when the spark-over on the first spark gap occurs, this spark gap is practically short circuited, and accordingly the greater part of the voltage occurs on the second spark gap or on the second and further spark gaps, so that a spark-over also takes place on the second and any further gaps. This in turn results in a quick and secure dissipation of the short circuit or excess current. The above-mentioned splitting up into several part-arcs is particularly favorable for restabilization after passage of the current zero, as the multiplication of the arcs also automatically expedites stabilization. This prevents or at least greatly obstructs the restriking after the zero passage of the current which, in turn, results in very good dissipating properties and, in the case of very unfavorable power line conditions such as an unfavorable cos$\zeta$, in quickly recurring voltages.

As noted above, in connection with the description of the state of the art, resistance controls with one single conductive insulator are known. The present invention also provides a resistance control, but not in the manner of the prior art, as will become apparent from the following description.

The invention creates an arrangement of lightning current carrying spark gaps for power line applications, which is constructed as a controlled multiple spark gap consisting of at least two series connected spark gaps with a response voltage which corresponds approximately to the response voltage of one single spark gap and thus can be kept relatively low. The over-voltage which occurs in the event of a disturbance finds only one single spark gap, but the recurring voltage finds two spark gaps. At the same time, an optimized dissipating behavior is obtained by a "widening" of the arc as a result of the serial multiple spark gap, since the arc is split up into at least two completely separate part-arcs. The separate part arcs nevertheless behave as one arc, the length of which corresponds to the addition of the lengths of both (or several) part-arcs. In order to obtain the low response voltage, the voltage is split over the individual spark gaps by the use of insulating layers of a material with greatly differing conduction values or specific electrical resistances. Accordingly, a resistance control is obtained without having to provide, in addition to the spark gaps themselves, further means, such as external resistances.

The insulating layer of the first spark gap can include either a very high-resistance material, e.g. a pure polymethylene oxide (PMO), or an air layer or a gas discharger. The low-resistance insulating layers of the second spark gap or of the second and further spark gaps of such an arrangement include an insulating material, the specific resistance of which is considerably smaller than that of the insulating layer of the first spark gap. This may, for example, be the aforementioned PMO, but to which conductive particles, e.g. metal or graphite particles, have been added, which greatly increases the conductivity of the material compared to pure PMO. When the insulating layers of the first as well as of the second and/or further spark gaps are made of a material which blows off gas, such as the above-mentioned PMO, still further advantages are obtained with regard to the extinguishing of the arc.

The spark gaps of the arrangement may be arranged spatially above one another, which has the advantage of a spatially highly compact design. When the insulating layer or insulating layers consist of a material, it is the spark-over path is preferably constructed as a surface discharge gap. This is particularly advantageous where the insulating material, when heated by the arc, gives off a gas which pushes or blows the arc to the outside (e.g. the above-mentioned PMO that blows off ($H_2$).

The invention furthermore provides possibilities for varying the course and direction of the surface discharge gaps and the blowing off direction by a corresponding configuration of the insulating layers and of the electrodes of the spark gap.

DETAILED DESCRIPTION OF THE PREFERRED EMBODIMENTS

Figure 1A:
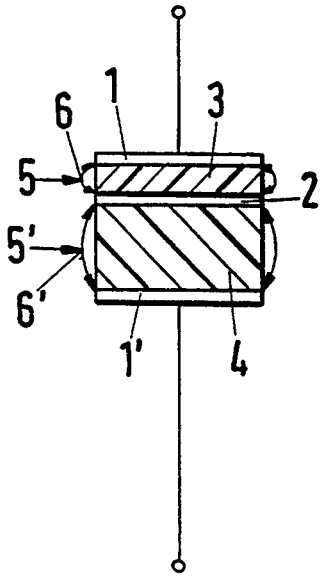
FIGS. 1*a*, 1*b*, and 1*c* are schematic diagrams illustrating construction principals of three preferred embodiments of the invention.
Figure 1B:
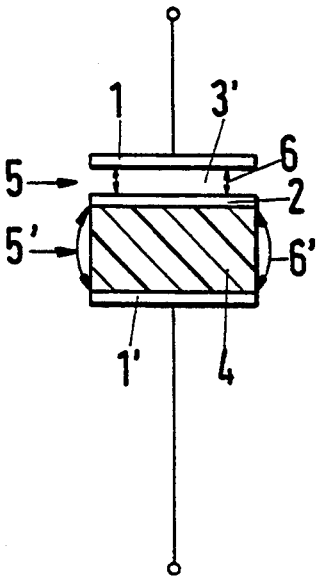

FIGS. 1*a* and 1*b* each show the spark gap arrangement of a preferred embodiment of the invention which includes a high-resistance spark gap 5 and a low-resistance spark gap 5', and in which the electrodes are denoted by the reference numerals 1, 1' and 2. In this embodiment, the intermediate electrode 2 serves functionally as an electrode of the spark gap 5 as well as of the spark gap 5'. In the example of FIG. 1*a*, the insulating layer is made up of a high-resistance material 3, such as the aforementioned pure PMO, whereas the insulating layer 4 of the low-resistance spark gap 5' is made up of a material with a conductivity which is considerably greater than the conductivity of the material of layer 3. This may, for example, be a PMO which contains suitable impurities consisting of metal or graphite particles. The ratio of the aforementioned conductivities (or reciprocally the ratio of the specific resistances) of the materials of the insulating layers 4 and 3 may, for example, amount to up to 10 000:1. In the example of FIG. 1*b*, the electrodes 1, 2 and 1 as well as the insulating layer 4 of FIG. 1*a* are provided. Instead of the layer 3 of a high-resistance material, however, an air space 3' is provided. Alternatively, instead of air space 3', a gas discharger could also be provided (not illustrated in the drawing).

It should be noted that in both the aforementioned cases, i.e. spark gaps in the configurations shown in FIGS. 1*a* and 1*b*, corresponding to the thicknesses of the insulating layers 3, 3' and 4, the length of the spark-over path 6 of the high-resistance spark gap 5 is smaller than the length of the spark-over path 6' of the low-resistance spark gap 5'.

Figure 1C:
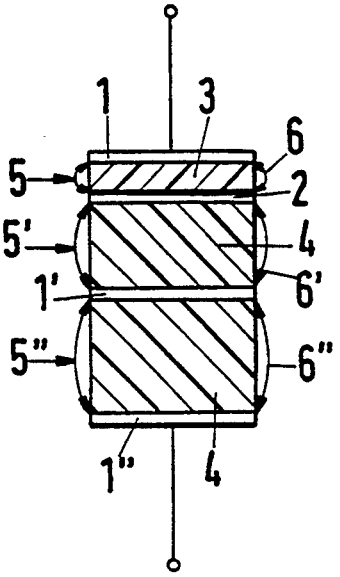

The preferred embodiment of FIG. 1*c* proceeds from the construction of the preferred embodiment of FIG. 1*a*, but includes a further spark gap 5''. The electrode 1' in this embodiment serves as a common electrode for the spark gaps 5' and 5'' whereas the spark gap 5'' on the underside still has an electrode 1''. The spark-over paths of the two low-resistance spark gaps 5', 5'', and accordingly the part-arcs 6', 6'' occurring there, are also, in this embodiment greater than the spark-over path and accordingly the arc 6 of the high-resistance spark gap 5.

In all preferred embodiments described herein, the spark gaps are both series connected electrically, and may be or are spatially arranged in a line. If required, a third or fourth low-resistance spark gap may also be provided and could, in the embodiment shown in FIG. 1*c*, be arranged underneath the spark gap 5''.

The basic diagrams of FIGS. 1*a*–1*c* show that in principle in this simplified construction, the different lengths of the spark-over paths, and accordingly the arcs occurring there, can be obtained by a suitable choice of the thickness of the insulating layers 3, 3', 4 between the respective electrodes. In these cases, the spark-over paths extend as surface discharge gaps along the casing of the discs 3, 4 that form the insulating layers, or in the case of the insulating layer 3' of FIG. 1*b*, which consists of air, as a breakdown between the electrodes 1, 2. In this regard, it should be noted that the spark gaps according to the invention are made, at least in the area of the aforementioned surface discharge gaps, rotationally symmetrical, and preferably cylindrical.

Functionally, all embodiments of the invention have in common a high-resistance spark gap which insulates one or several low resistance spark gaps from the power line, and accordingly determines the response voltage. In the event of a response both the high-resistance spark gap and the low-resistance spark gap or the low-resistance spark gaps form arcs and dissipate the excess current. The large spark-over paths, preferably surface discharge gaps of the low-resistance spark gap or the low-resistance spark gaps, create an enlarged sparking distance and accordingly a greater arc length for the arc 6'. This provides the above-mentioned advantages with respect of dissipation of excess current without having an adverse effect on the response behavior of the overall arrangement. In particular, when the insulating layers 3, 4 of the spark gaps are constructed of a material which, when heated, blows off gas, the self-dynamic of the arc, i.e. its tendency to push to the outside, is increased. This results in additional energy losses of the arc as a result of the cooling which occurs, due to which the extinguishing behavior of the arc is improved further.

The series connection of several low-resistance spark gaps to a high-resistance spark gap changes the response behavior of the overall arrangement only slightly. Although the high-resistance spark gap and the low-resistance spark gap or the low-resistance spark gaps cooperate as explained, there nevertheless exists a functional separation between the spark gaps because the high-resistance spark gap primarily fulfills the task of "insulating" and "responding", whereas the low-resistance spark gaps have more the function of dissipating the excess current.

FIGS. 2–7 show details of a further preferred embodiment of the invention which in principle is constructed according to FIG. 1*a*, but wherein the spark-over paths according to details A and B differ from those of FIG. 1*a*.

The two spark gaps 5 and 5' including the parts 1, 3, 2 of the one side and 2, 4, 1' of the other side are provided in a common housing 7 which at its front end is closed off by outside contact plates 8, connected by connection brackets 8' to form, for example, bow terminals. The housing 7 is lined on the inside with two extinguishing chamber walls 9, which surround extinguishing chambers 10, one of which is provided for each of the spark gaps 5, 5', and wherein in the present embodiment the extinguishing chambers are separated by the electrode 2. Alternatively, a common extinguishing chamber could be provided for both spark gaps 5, 5', in which case the electrode 2 would have to have a different shape. The housing 7 is preferably made of an insulating material, so that with respect to the contact plates 8 it need only be insulated as necessary to prevent the arc from forming an electrical through connection due to a conductive deposit on the inside wall of the housing. Cover plates 22 are used for this, and are constructed in such a way that they surround the electrodes in the form of a ring, separated by a narrow gap 23 (see in particular FIG. 6). The ratio between the width of the gap 23' and the width of the ring-shaped cover plate 22 is such that on the rear ring surface a vapor deposit-free zone 23 is formed in which, due to the extinguishing of the arc or the dissipation of the metal vapor transporting gas, no conductive connection is possible because a vapor-deposit blockage is formed. This effect is enhanced by an additional web 22' on the inside radius of the cover plate 22, which forms a further gap 23'' with the contact plate 8. A further web 22'' on the outside radius of the cover plate 22 adjoins the contact plate 8 and at the same time protects the upper part of the inside wall of the housing 7 against vapor deposits. The extinguishing chamber walls preferably are made of a plastic which, when heated, gives off a gas which pushes the arc gases and burn-up gases to the outside through an outlet opening 11. The contact plates 8 and cover plates 22 also serve to screw the contact plates 8 to the housing 7 and at the same time produce a contact pressure between the electrodes 1, 2 and 2, 1' and their insulating layers 3, 4.

Figure 2:
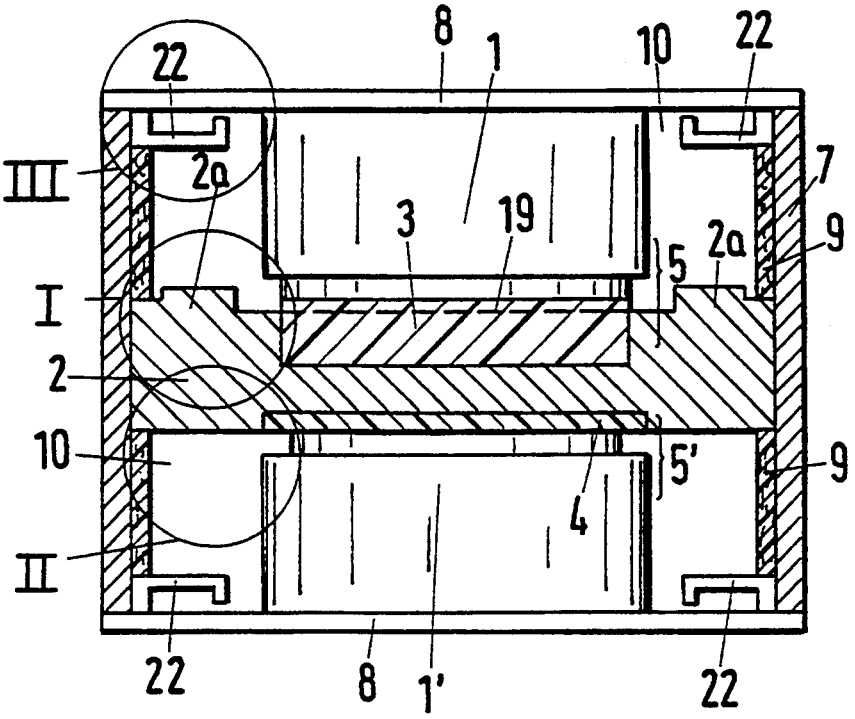
FIG. 2 shows in longitudinal section an exemplary preferred embodiment of the invention.
Figure 3:
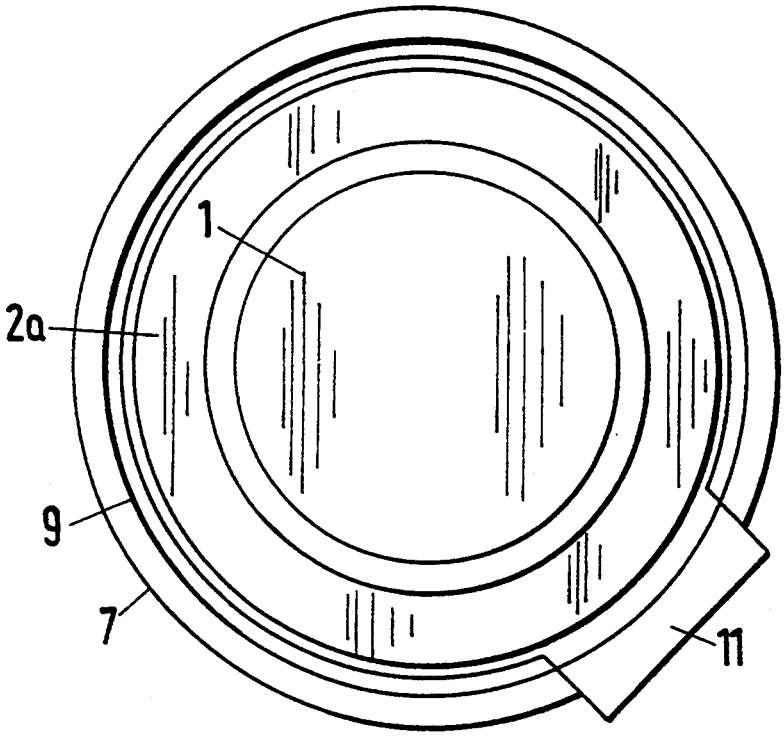
FIG. 3 shows a top view of the embodiment of FIG. 2.

As shown in FIG. 2, the insulating layer 3 of the high-resistance spark gap 5 is considerably thicker than the insulating layer 4 of the low-resistance spark gap 5'. However, the performance of the present preferred embodiment is not degraded as a result because the great difference in the specific resistances of the layers 3, 4 the prevents the consequent voltage drops from being noticeably influenced by the thicknesses of the insulating layers.

Another feature which contributes to the above-noted advantages is the difference in the lengths of the sparkover paths 6, 6'. These spark-over paths are indicated in the form of sliding discharge gaps 6, 6' in the details A and B illustrated in FIGS. 4 and 5. In the case of detail A (FIG. 4), the length of the part d of the insulating layer 5 projecting upwards above the electrode 2 is decisive for the sliding discharge gap 6 occurring there. In the case of detail B (FIG. 5), the distance e between the edge 21 of the electrode 1' and the edge 2' of the electrode 2 is decisive for the size of the sliding discharge gap occurring there. The distance e, i.e. the length of the arc 6' on the low-resistance spark gap 5', is greater than the part d and accordingly the length of the arc 6 on the high-resistance spark gap 5. In this regard, it should be noted that it is within the scope of the invention to let the occurring arcs extend horizontally/vertically as in the present preferred embodiment, but also vertically/vertically, horizontally/horizontally, or at an acute angle to the longitudinal axis of the spark gap. The ratio between the lengths of the arc 6' of the low-resistance spark gap and the arc 6 of the high-resistance spark gap may also be different than illustrated in the drawing. In practice, ranges of 4:1 to 5:1 are preferred, but those skilled in the art will appreciate that those ranges are not intended to be limiting.

If, according to the preferred embodiment of the invention, the insulating layers are made of a material which, when heated, gives off gas (e.g. the abovementioned PMO), then the gas pushes the arc in accordance with arrow 13 to the outside until it becomes either, as illustrated by detail A, the arc 14 between the edges 15 and 16 or, as illustrated by detail B, the arc 17 between the edges 2' and 18. To achieve this, for the high-resistance spark gap, the electrode 2 is provided with an all-round web 2a, which forms the edge 16, whereas the electrode 2 is provided on the underside with the edge 2' and the electrode 1' with the edge 18. As a result, an overall length of the arc is obtained which is greater than the overall length of the arcs 6, 6'. This has a favorable effect on the extinguishing operation.

Figure 4:
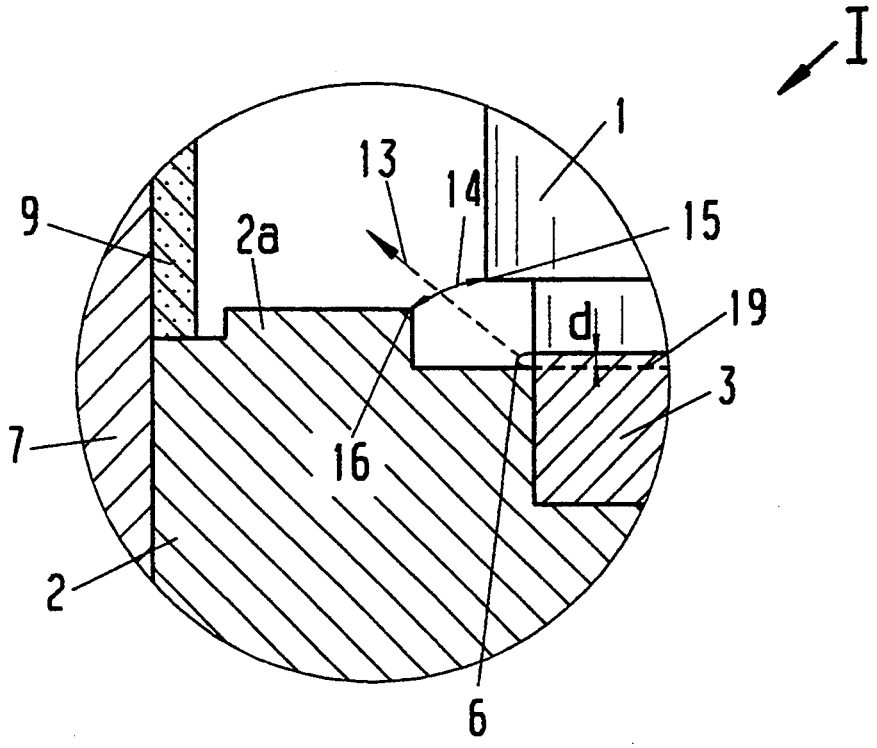
FIG. 4 shows on a larger scale detail A of FIG. 2.
Figure 5:
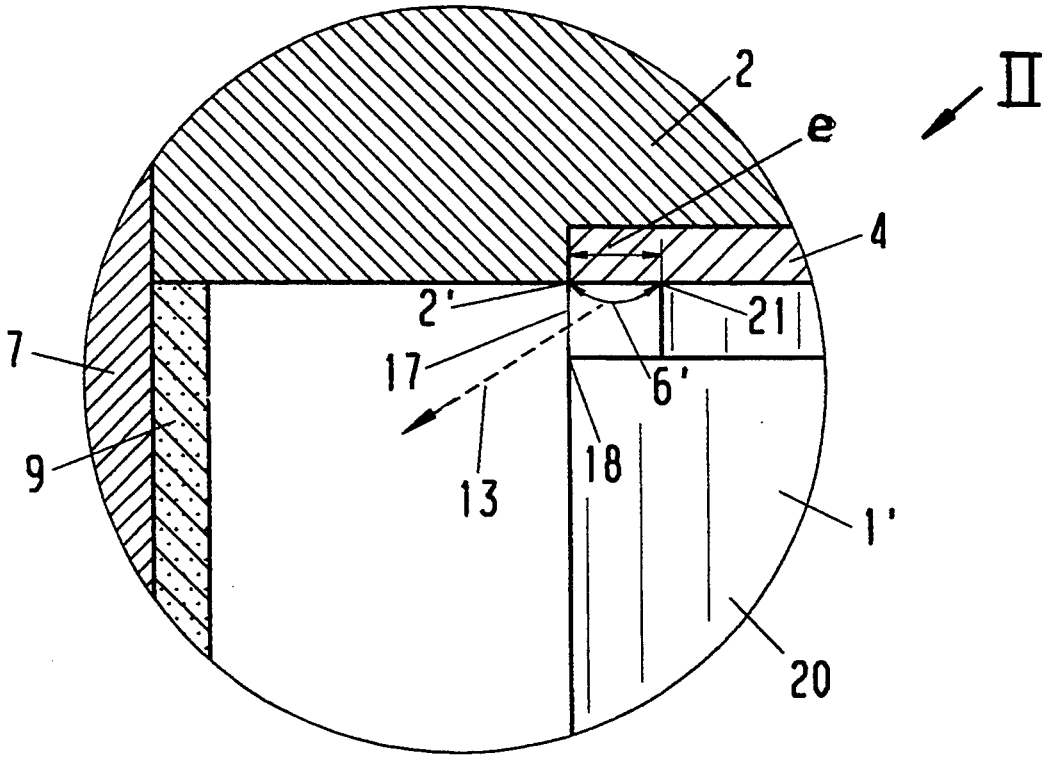
FIG. 5 shows on a larger scale detail B of FIG. 2.
Figure 6:
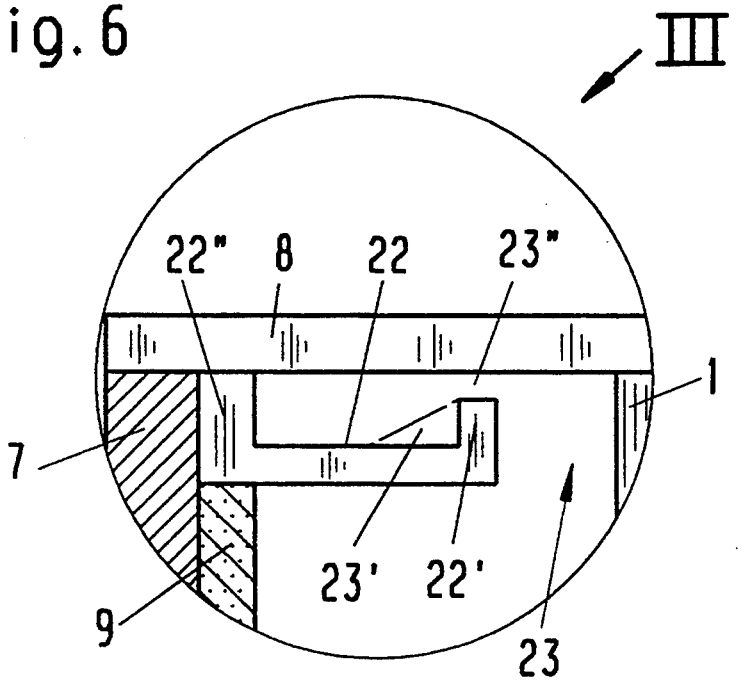
FIG. 6 shows on a larger scale detail C of FIG. 2.
Figure 7:
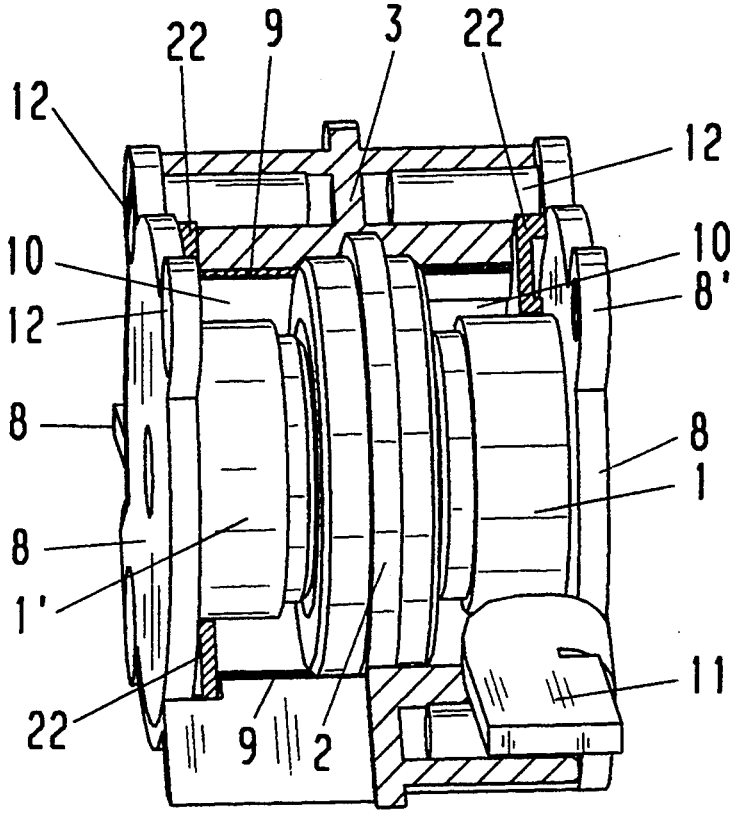
FIG. 7 shows, partly in section and partly in a perspective view, the exemplary embodiment of FIG. 2, but in a position turned by 90° in comparison to the position shown in FIG. 2.

It will be appreciated that only that part of the insulating layer 3 which is positioned above the dot-dash line 19 is active for the formation of the surface discharge gap and accordingly for the arc 6. On the other hand, the part of the insulation 3 positioned underneath the line 19 is inactive for the formation of the arc. It serves to hold the insulating layer 3 in the electrode 2, and furthermore, because of its mass, serves as a thermal stabilizer in that it absorbs part of the heat which occurs in the active part of the insulating layer positioned above the line 19. In addition, the part of the insulating layer 3 positioned underneath the line 19 and accordingly in a recess of the electrode 2 ensures that material losses caused by the arc temperature extend from the area of the sliding discharge gap 6, i.e. the edge of the insulating layer 3 (see FIG. 4), substantially along the edge of the insulating layer 3 to the bottom of the recess of the electrode 2 which holds it, i.e., as shown in FIG. 4, from the area of the arc 6 downwards. If the part of the insulating layer 3 positioned underneath the line 19 were not there, then the risk would exist that the arc would burn off the entire insulating layer above the line 19, or an electrode surface present there, with the result that the distance d could no longer be maintained and the electrode 1, due to the pressing force acting on it, would be pushed in the direction of the electrode 2. This in turn would have harmful effects on the electrical properties of the sliding discharge gap 6. The same applies to the other spark gap illustrated in FIG. 5, including the electrodes 2, 1' and the insulating layer 4 with the sliding discharge gap 6'.

When the gas releasing material of the insulating layers 3, 4 starts to blow, and the arc 6 or 6', respectively, starts to move to the outside according to the arrow 13, it gets stuck at the catch edges 15, 16 or 2', 18 respectively In this stage, the electrodes 1, 2 and 2, 1' respectively act as collecting electrodes. As a result, it is possible to create, with regard to the respective effective thickness (d) or length (e) of that part of the insulating layers 3 or 4 which forms the spark-over path, a desired length of the respective arc and a corresponding overall length of the arc occurring on the arrangement As the base points 15, 16 and 2', 18 respectively move on the electrodes in the direction of the extinguishing chamber 10, the arcs are extinguished. Any gases present are blown out at 11, as explained above.

The movement of the arc to the area between the edges 15, 16 and 2', 18 respectively, has the additional advantage of offering considerable thermal relief for the insulating material 3 and 4, respectively, in the area of the illustrated arcs 6, 6' and the associated areas of the electrodes. The above-mentioned thickening of the insulating layers to increase their thermal stability, as illustrated with reference to insulating layer 3, also contributes to the thermal relief. In a corresponding manner (not illustrated in the drawing), the mass of the insulating layer 4 may be increased in order to, together with moving the arc as explained above to an area further away from the insulating material and the electrodes, eliminate the risk of a harmful burn-up on the insulating layers and the electrodes. Such a thermal burn-up could in extreme cases burn away the entire insulating layer 3 or 4, respectively, and could accordingly cause the spark gap to short circuit. Advantageously, the materials of the electrodes preferably used are extremely burn resistant, thus providing further resistance to burn-ups.

Having thus described preferred embodiments of the invention and variations and modifications thereof in sufficient detail to enable those skilled in the art to make and use the invention based on the above description and accompanying drawings, it is nevertheless intended that the invention not be limited by the description or illustrations, but rather that it be defined solely by the appended claims.

We claim:

1. A spark gap arrangement capable of carrying lightning current, comprising at least two series-connected spark gaps, wherein each of said at least two spark gaps includes two electrodes and means consisting of an insulating layer arranged between the two electrodes for forming a spark-over path, wherein a thickness of a first of the at least two insulating layers is different from a thickness of a second of the at least two insulating layers, wherein the first insulating layer has a resistance which is higher than that of the second insulating layer, and wherein the first insulating layer forms a spark-over path which is shorter than a spark-over path formed by the second insulating layer.

2. An arrangement as claimed in claim 1, further comprising at least one additional spark gap connected in series with the second spark gap, said additional spark gap including a third insulating layer, and said third insulating layer having a lower resistance and a longer spark-over path than the first insulating layer.

3. An arrangement as claimed in claim 1, wherein the first insulating layer consists of a layer of air.

4. An arrangement as claimed in claim 1, wherein the first insulating layer consists of a gas discharger.

5. An arrangement as claimed in claim 1, wherein the first insulating layer consists of a solid high resistance insulating material.

6. An arrangement as claimed in claim 2, wherein the second insulating layer and the third insulating layer consist of a solid low-resistance insulating material.

7. An arrangement as claimed in claim 1, wherein the second insulating layer consists of a solid low-resistance insulating material.

8. An arrangement as claimed in claim 1, wherein the first and second insulating layers include a material which, when heated, blows off gas.

9. An arrangement as claimed in claim 8, wherein the material that blows off gas is a thermoplastic plastic that gives of hydrogen gas ($H^2$).

10. An arrangement as claimed in claim 9, wherein the material that blows off gas is polymethylene oxide (PMO).

11. An arrangement as claimed in claim 10, wherein the first insulating layer is made of pure PMO and the second insulating layer is made of PMO which includes conductive particles.

12. An arrangement as claimed in claim 11, wherein said conductive particles are selected from the group consisting of graphite particles and metal particles.

13. An arrangement as claimed in claim 2, wherein the first insulating layer is made of polymethylene oxide (PMO) and the second and third insulating layers are made of PMO which includes conductive particles.

14. An arrangement as claimed in claim 13, wherein said conductive particles are selected from the group consisting of graphite particles and metal particles.

15. An arrangement as claimed in claim 1, wherein the at least two spark gaps are arranged spatially above one another.

16. An arrangement as claimed in claim 1, wherein the insulating layers and electrodes are arranged to cause a spark-over between the electrodes to take place along a sliding discharge gap of a respective insulating layer.

17. An arrangement as claimed in claim 16, wherein a surface discharge gap of a respective one of the at least two insulating layers extends along a rotationally symmetrical casing of the respective one insulating layer.

18. An arrangement as claimed in claim 17, wherein the casing is cylindrical.

19. An arrangement as claimed in claim 17, wherein the first insulating layer is positioned within one of the electrodes and with only a part of the first insulating layer extending beyond a surface of the one electrode.

20. An arrangement as claimed in claim 19, wherein a thickness of a part of the first insulating layer positioned within the one electrode is greater than a thickness of the part of the first insulating layer extending beyond the surface of the one electrode.

21. An arrangement as claimed in claim 16, wherein one of the insulating layers is disc-shaped and wherein a sliding discharge gap of a respective one of the at least two insulating layers extends in a radially outward direction of the disc-shaped insulating layer.

22. An arrangement as claimed in claim 21, wherein the second insulating layer is positioned within one of the electrodes, and wherein a surface of the first insulating layer is flush with a surface of the one electrode within which it is positioned.

23. An arrangement as claimed in claim 1, wherein a ratio between an ohmic resistance of the first insulating layer and that of the second insulating layer is about 10000:1.

24. An arrangement as claimed in claim 1, wherein a ratio between a length of a sliding discharge gap of the spark gap which includes the first insulating layer and a length of a sliding discharge gap of the spark gap which includes the second insulating layer is about 1:4 to 1:5.

25. An arrangement as claimed in claim 8, wherein in a blowing direction of an insulating material of the insulating layers, catch edges for each of the two electrodes belonging to one of the spark gaps are positioned at a distance from one another which at first holds an arc at a predetermined distance from a corresponding sliding discharge gap of the one spark gap.

26. An arrangement as claimed in claim 25, wherein each of the electrodes which include the catch edges has a circumferential web and a circumferential step, said web and said step forming said catch edges.

27. An arrangement as claimed in claim 1, wherein each of the at least two spark gaps includes an extinguishing chamber which has a blow-out opening.

28. An arrangement as claimed in claim 27, wherein the arc extinguishing chamber includes an insulating material which, when heated, blows off gas.

29. An arrangement as claimed in claim 27, wherein the at least two spark gaps are positioned in a common housing which also encloses the respective extinguishing chamber of each spark gap.

30. An arrangement as claimed in claim 29, wherein the housing is closed off by cover plates provided with connections projecting to an outside of the housing.

31. An arrangement as claimed in claim 30, further comprising means for preventing a continuous vapor deposit on an inside wall of the housing and accordingly a continuous electrically conductive connection.

32. An arrangement as claimed in claim 31, wherein cover plates cover respective surfaces of contact plates facing respective ones of the at least two spark gaps, and surround the electrodes, the cover plates being arranged as rings each separated from a respective electrode by a narrow ring-shaped air gap.

33. An arrangement as claimed in claim 32, wherein each of the cover plates has on an inside radius a web which is directed towards a respective contact plate and forms a gap with the respective contact plate.

34. An arrangement as claimed in claim 32, wherein an outer edge of each cover plate is arranged as a web-like cover for an inside surface of a wall of the housing which adjoins a respective contact plate.

* * * * *